US011221008B2

(12) United States Patent
Maeda et al.

(10) Patent No.: US 11,221,008 B2
(45) Date of Patent: Jan. 11, 2022

(54) SCROLL COMPRESSOR

(71) Applicant: KABUSHIKI KAISHA TOYOTA JIDOSHOKKI, Kariya (JP)

(72) Inventors: Takumi Maeda, Kariya (JP); Takayuki Ota, Kariya (JP); Takuro Yamashita, Kariya (JP); Yuya Hattori, Kariya (JP); Tatsunori Tomota, Nagakute (JP); Yasuhiro Kondoh, Nagakute (JP); Ryou Masuda, Nagakute (JP); Etsuko Hori, Nagakute (JP); Yu Nozawa, Nagakute (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 120 days.

(21) Appl. No.: 16/829,494

(22) Filed: Mar. 25, 2020

(65) Prior Publication Data

US 2020/0309128 A1 Oct. 1, 2020

(30) Foreign Application Priority Data

Mar. 28, 2019 (JP) ..... JP2019-064022

(51) Int. Cl.
*F04C 18/02* (2006.01)

(52) U.S. Cl.
CPC ..... *F04C 18/0269* (2013.01); *F04C 18/0215* (2013.01); *F04C 2270/12* (2013.01)

(58) Field of Classification Search
CPC .... F04C 18/0269; F04C 18/0207–0292; F04C 18/0215; F04C 2270/12; F04C 2270/13
See application file for complete search history.

(56) References Cited

U.S. PATENT DOCUMENTS 4,490,099 A * 12/1984 Terauchi ..... F01C 1/0246 418/55.2
4,773,835 A * 9/1988 Machida ..... F04C 18/0269 418/55.2
4,904,170 A * 2/1990 Suefuji ..... F01C 1/0246 418/55.2
5,165,878 A * 11/1992 Inagaki ..... F04C 18/023 418/55.3
5,318,424 A * 6/1994 Bush ..... F04C 18/0269 418/55.2
5,425,626 A * 6/1995 Tojo ..... F01C 1/0246 418/55.2

(Continued)

FOREIGN PATENT DOCUMENTS

JP 04054201 A * 2/1992 ..... F04C 18/0269
JP 7-035058 A 2/1995

*Primary Examiner* — Mark A Laurenzi
*Assistant Examiner* — Xiaoting Hu
(74) *Attorney, Agent, or Firm* — Sughrue Mion, PLLC

(57) ABSTRACT

A scroll compressor is provided. An orbiting angle of the orbiting scroll when the compression chamber is formed and compression of fluid is initiated is referred to as an orbiting initiation angle. An orbiting angle of the orbiting scroll when the compression of the fluid is completed is referred to as an orbiting termination angle. An orbiting angle of the orbiting scroll when an end of the orbiting spiral wall initiates contact with the arcuate portion of the fixed spiral wall before compression is completed is referred to as a distal end contact initiation angle. The formation point distance reaches a minimum value at least at one of a first orbiting angle or a second orbiting angle.

2 Claims, 5 Drawing Sheets

(56) References Cited

U.S. PATENT DOCUMENTS 5,458,471 A * 10/1995 Ni ..... F04C 27/005 418/1
5,513,967 A * 5/1996 Nakamoto ..... F04C 18/0269 418/1
5,836,752 A * 11/1998 Calhoun ..... F04C 18/0269 418/55.2
5,938,417 A * 8/1999 Takao ..... F04C 18/0246 418/55.2
6,102,671 A * 8/2000 Yamamoto ..... F04C 18/0269 417/310
6,193,488 B1 * 2/2001 Kamiya ..... F04C 18/0269 418/55.2
6,224,357 B1 * 5/2001 Komai ..... F01C 21/102 418/55.2
6,345,967 B1 * 2/2002 Mukai ..... F04C 18/0269 418/55.2
6,736,622 B1 * 5/2004 Bush ..... F04C 18/0269 418/1
8,308,460 B2 * 11/2012 Seong ..... F04C 18/0269 418/55.2
9,371,832 B2 * 6/2016 Kiem ..... F04C 18/0284
10,962,006 B2 * 3/2021 Kim ..... F04C 18/0269
11,078,909 B2 * 8/2021 Maeda ..... F04C 18/0269
2008/0145253 A1 * 6/2008 Uekawa ..... F01C 17/00 418/55.3
2012/0288394 A1 * 11/2012 Murakami ..... F04C 18/0269 418/55.1
2014/0363325 A1 * 12/2014 Park ..... F04C 18/0215 418/55.1
2015/0037189 A1 * 2/2015 Inada ..... F01C 1/0269 418/55.2
2016/0108915 A1 * 4/2016 Deguchi ..... F04C 18/0215 418/55.2
2019/0345933 A1 * 11/2019 Choi ..... F04C 18/0215

* cited by examiner

SCROLL COMPRESSOR

BACKGROUND

1. Field

The present description relates to a scroll compressor.

2. Description of Related Art

A scroll compressor includes a fixed scroll fixed inside a housing and an orbiting scroll orbiting about the fixed scroll. The fixed scroll includes a fixed base and a fixed spiral wall extending from the fixed base. The orbiting scroll includes an orbiting base and an orbiting spiral wall extending from the orbiting base. The fixed spiral wall and the orbiting spiral wall are engaged with each other to define a compression chamber. The orbiting movement of the orbiting scroll reduces the volume of the compression chamber and compresses fluid (such as refrigerant).

The fixed spiral wall and the orbiting spiral wall of such a scroll compressor may each extend along an involute curve. Japanese Laid-Open Patent Publication No. 07-35058 discloses an example of the scroll compressor. The fixed spiral wall and the orbiting spiral wall each include a first portion that extends along a corrected curve and a second portion that is continuous with the first portion and extends along an involute curve. The corrected curve is an involute curve corrected with a correction coefficient. The second portion is located outward from the first portion and extends over a single winding of the spiral wall. The first portion has a varying wall thickness and the second portion has a constant wall thickness.

The fixed spiral wall and the orbiting spiral wall each include a first end located toward the center. The correction coefficient is set so that in the vicinity of the first end, the distance from a base circle of the involute curve to the corrected curve is shorter than the distance from the center of the base circle of the involute curve to the involute curve. This increases the wall thickness at a location where the pressure of the compression chamber is high immediately before the fluid is discharged and thereby improves the durability.

The compressing force of the scroll compressor changes greatly as refrigerant, which is compressed in the high-pressure compression chamber, is discharged out of the compression chamber and thereby generates vibration. The scroll compressor disclosed in the above publication sets the wall thickness of the spiral walls to withstand the high pressure immediately before compression is completed. However, no measures are taken against the vibration generated after compression.

SUMMARY

It is an object of the present disclosure to provide a scroll compressor that reduces vibration resulting from a change in compressing force.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor is provided. The scroll compressor includes a fixed scroll including a fixed base and a fixed spiral wall extending from the fixed base and an orbiting scroll including an orbiting base, which is opposed to the fixed base, and an orbiting spiral wall, which extends from the orbiting base toward the fixed base and is engaged with the fixed spiral wall. The fixed scroll and the orbiting scroll are configured to cooperate to form a compression chamber. The scroll compressor is configured to compress fluid in the compression chamber when the orbiting scroll orbits. The fixed spiral wall extends along an involute curve. The involute curve of the fixed spiral wall has a base circle with a center referred to as a fixed base circle center. The orbiting spiral wall extends along an involute curve. The involute curve of the orbiting spiral wall has a base circle with a center referred to as an orbiting base circle center. The fixed base circle center and the orbiting base circle center lie along a straight line referred to as a radial direction line. The fixed spiral wall and the orbiting spiral wall come into contact with each other or are proximate to each other at a location referred to as a formation point. The fixed spiral wall and the orbiting spiral wall are configured to form the compression chamber when in contact with each other or located proximate to each other at the formation point. The radial direction line and the formation point are spaced apart by a distance referred to as a formation point distance. The fixed spiral wall has an inner circumferential surface including an arcuate portion continuous with a distal end of the fixed spiral wall. An orbiting angle of the orbiting scroll when the compression chamber is formed and compression of fluid is initiated is referred to as an orbiting initiation angle. An orbiting angle of the orbiting scroll when the compression of the fluid is completed is referred to as an orbiting termination angle. An orbiting angle of the orbiting scroll when an end of the orbiting spiral wall initiates contact with the arcuate portion of the fixed spiral wall before compression is completed is referred to as a distal end contact initiation angle. An orbiting angle obtained by subtracting 360° from the orbiting termination angle is referred to as a final orbiting initiation angle. An orbiting angle in a range from the orbiting initiation angle to the orbiting termination angle and in a range from the final orbiting initiation angle to the distal end contact initiation angle is referred to as a first orbiting angle. An orbiting angle in the range from the orbiting initiation angle to the orbiting termination angle and obtained by subtracting an integer multiple of 360° from the first orbiting angle is referred to as a second orbiting angle. The formation point distance reaches a minimum value at least at one of the first orbiting angle or the second orbiting angle.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A scroll compressor according to one embodiment will now be described with reference to the drawings.

Figure 1:
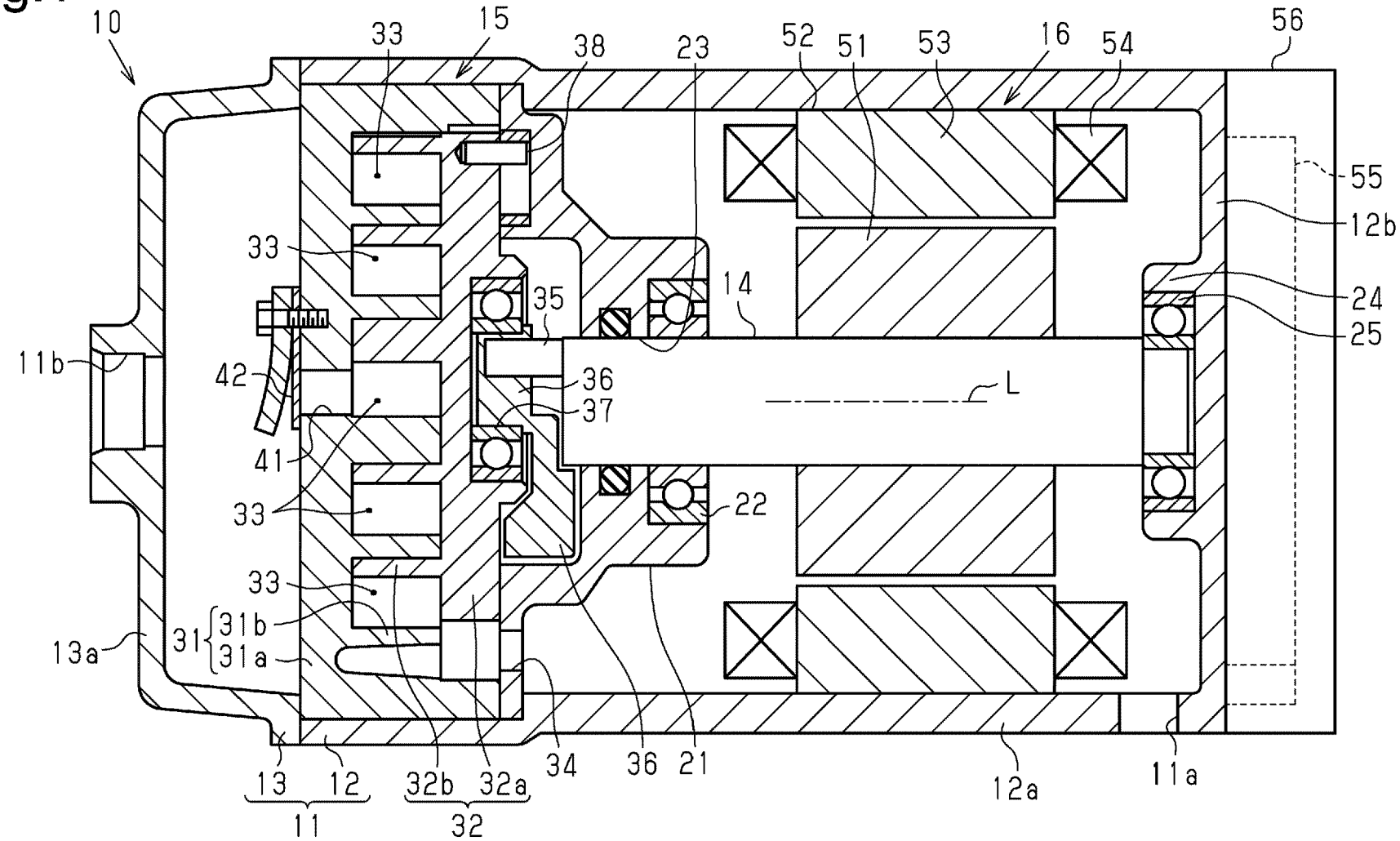
FIG. 1 is a cross-sectional view showing a scroll compressor according to one embodiment.

As shown in FIG. 1, a scroll compressor 10 includes a housing 11 that has a suction inlet 11*a* through which fluid is drawn and a discharge outlet 11*b* through which fluid is discharged. The housing 11 is substantially cylindrical in its entirety. The housing 11 includes two cylindrical parts 12 and 13, namely, a first part 12 and a second part 13 that are joined with their open ends in abutment with each other. The suction inlet 11*a* is arranged in a circumferential wall 12*a* of the first part 12. Specifically, the suction inlet 11*a* extends through the circumferential wall 12*a* near an end wall 12*b* of the first part 12. The discharge outlet 11*b* extends through an end wall 13*a* of the second part 13.

The scroll compressor 10 includes a rotation shaft 14, a compression unit 15, and an electric motor 16. The compression unit 15 compresses the fluid drawn from the suction inlet 11*a* and discharges the compressed fluid out of the discharge outlet 11*b*. The electric motor 16 drives the compression unit 15. The rotation shaft 14, the compression unit 15, and the electric motor 16 are accommodated in the housing 11. The electric motor 16 is arranged near the suction inlet 11*a* inside the housing 11, and the compression unit 15 is arranged near the discharge outlet 11*b* inside the housing 11.

The rotation shaft 14 is rotationally accommodated in the housing 11.

Specifically, the housing 11 includes a shaft support 21 that supports the rotation shaft 14. The shaft support 21 is, for example, fixed to the housing 11 between the compression unit 15 and the electric motor 16. The shaft support 21 includes an insertion hole 23 through which the rotation shaft 14 is inserted. A first bearing 22 is arranged in the insertion hole 23. Further, the shaft support 21 is opposed to the end wall 12*b* of the first part 12. A cylindrical boss 24 projects from the end wall 12*b*. A second bearing 25 is arranged inside the boss 24. The rotation shaft 14 is rotationally supported by the bearings 22 and 25.

The compression unit 15 includes a fixed scroll 31 fixed to the housing 11 and an orbiting scroll 32 configured to move about the fixed scroll 31 so as to produce an orbiting action.

The fixed scroll 31 includes a disc-shaped fixed base 31*a* arranged coaxially with the rotation shaft 14 and a fixed spiral wall 31*b* extending from the fixed base 31*a*. The orbiting scroll 32 also includes a disc-shaped orbiting base 32*a*, which is opposed to the fixed base 31*a*, and an orbiting spiral wall 32*b* extending from the orbiting base 32*a* toward the fixed base 31*a*. More specifically, the orbiting base 32*a* is opposed to the fixed base 31*a* in a direction in which axis L of the rotation shaft 14 extends.

The fixed scroll 31 and the orbiting scroll 32 are engaged with each other.

Specifically, the fixed spiral wall 31*b* and the orbiting spiral wall 32*b* are engaged with each other so that a distal end surface of the fixed spiral wall 31*b* is in contact with the orbiting base 32*a* and a distal end surface of the orbiting spiral wall 32*b* is in contact with the fixed base 31*a*. The fixed scroll 31 and the orbiting scroll 32 define a plurality of compression chambers 33 that compress fluid.

Figure 2:
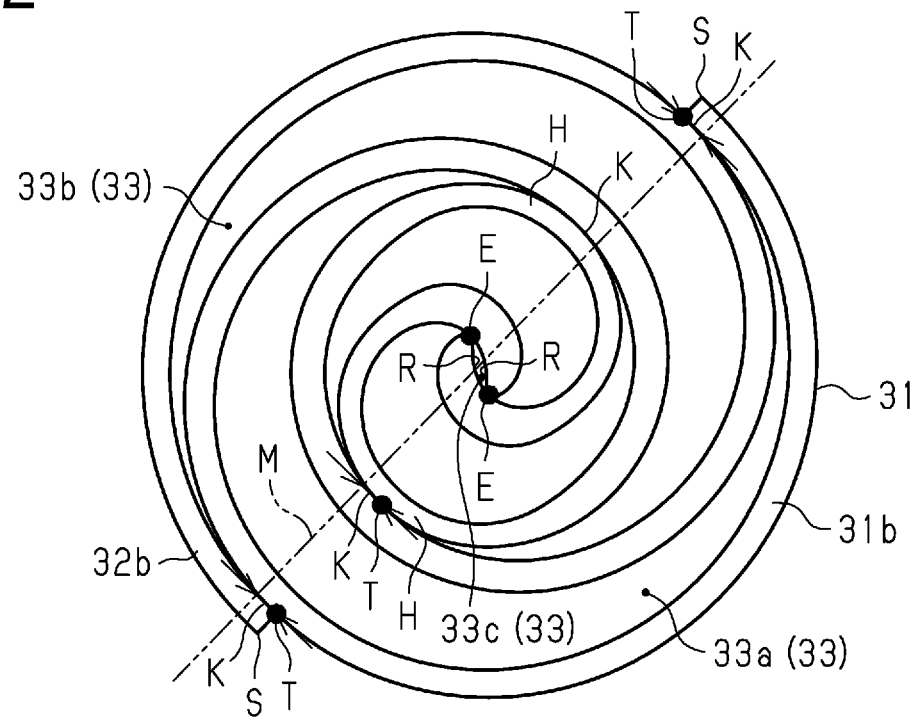
FIG. 2 is a diagram showing a fixed spiral wall and an orbiting spiral wall in the scroll compressor of FIG. 1.
Figure 5:
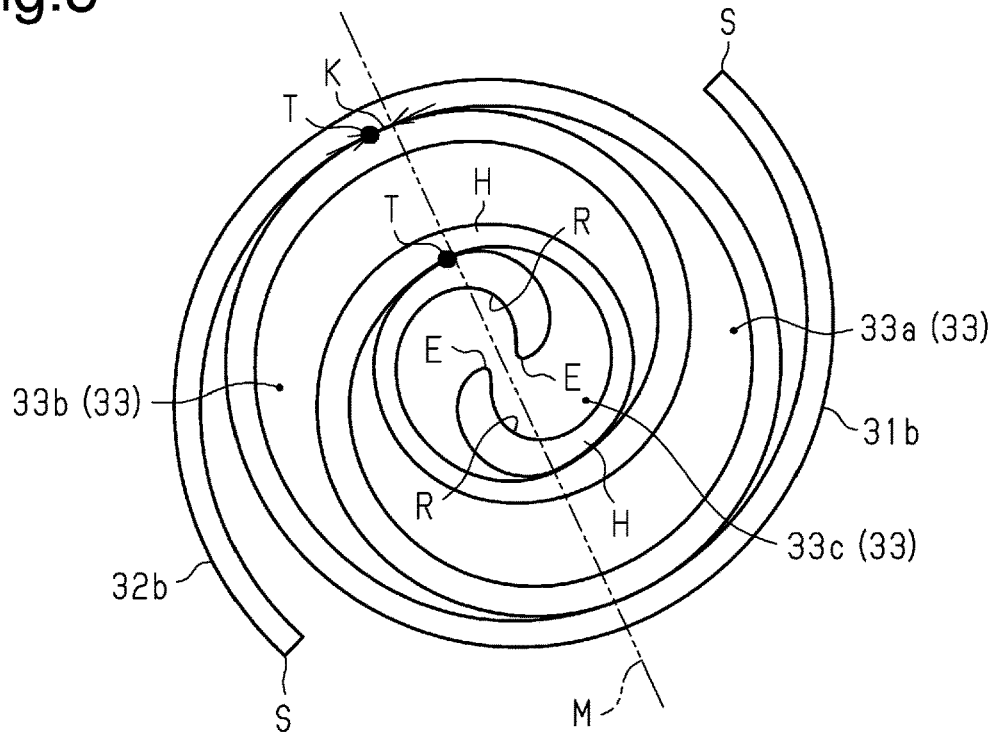
FIG. 5 is a diagram showing when a formation point distance reaches a minimum value.

FIG. 2 shows the fixed scroll 31 and the orbiting scroll 32 when fluid is first trapped in the compression chambers 33 by the fixed scroll 31 and the orbiting scroll 32. At this time, a first compression chamber 33*a* is formed by the inner circumferential surface of the fixed spiral wall 31*b* and the outer circumferential surface of the orbiting spiral wall 32*b*, and a second compression chamber 33*b* is formed by the outer circumferential surface of the fixed spiral wall 31*b* and the inner circumferential surface of the orbiting spiral wall 32*b*. In other words, the compression chambers 33 include the first compression chamber 33*a* and the second compression chamber 33*b*. The compression chambers 33 further include compression chambers 33 located inward from the first compression chamber 33*a* and the second compression chamber 33*b*. Further, as shown in FIG. 5, the orbiting action of the orbiting scroll 32 joins the first compression chamber 33*a* and the second compression chamber 33*b* and forms a central compression chamber 33*c* at the center of the fixed scroll 31. This simultaneously forms plural compression chambers 33 in the scroll compressor 10.

As shown in FIG. 1, the shaft support 21 includes an intake passage 34 through which fluid is drawn into the compression chamber 33. The orbiting scroll 32 is configured to orbit as the rotation shaft 14 rotates. Specifically, part of the rotation shaft 14 projects toward the compression unit 15 through the insertion hole 23 of the shaft support 21, and an eccentric shaft 35 projects from an end surface of the rotation shaft 14 toward the compression unit 15. The axis of the eccentric shaft 35 is eccentric relative to an axis L of the rotation shaft 14. The eccentric shaft 35 includes a bushing 36. The bushing 36 and the orbiting scroll 32 (i.e., orbiting base 32*a*) are connected by a bearing 37.

While the scroll compressor 10 allows for the orbiting action of the orbiting scroll 32, the scroll compressor 10 includes a plurality of rotation restrictors 38 that restrict rotation of the orbiting scroll 32. When the rotation shaft 14 rotates in a predetermined forward direction, the orbiting scroll 32 orbits in the forward direction. The orbiting scroll 32 orbits in the forward direction about the axis (i.e., axis L of rotation shaft 14) of the fixed scroll 31. This reduces the volume of the compression chamber 33 and compresses the fluid drawn into the compression chamber 33 through the intake passage 34. The compressed fluid is discharged out of a discharge port 41 extending through the fixed base 31*a* and then discharged out of the discharge outlet 11*b*. The fixed base 31*a* includes a discharge valve 42 that covers the discharge port 41. The fluid compressed in the compression chamber 33 forces open the discharge valve 42 and is discharged out of the discharge port 41.

The electric motor 16 rotates the rotation shaft 14 and orbits the orbiting scroll 32. The electric motor 16 includes a rotor 51, which rotates integrally with the rotation shaft 14, and a stator 52 surrounding the rotor 51. The rotor 51 is connected to the rotation shaft 14. The rotor 51 includes permanent magnets (not shown). The stator 52 is fixed to the inner circumferential surface of the housing 11 (i.e., first part 12). The stator 52 includes a stator core 53, which opposes the cylindrical rotor 51 in the radial direction, and coils 54, which are wound around the stator core 53.

The scroll compressor 10 includes an inverter 55, which is a driving circuit that drives the electric motor 16. The inverter 55 is accommodated in the housing 11, specifically, in a cylindrical cover member 56 attached to the end wall 12*b* of the first part 12. The inverter 55 is electrically connected to the coils 54.

FIGS. 2 to 6 show only the fixed spiral wall 31*b* of the fixed scroll 31 and the orbiting spiral wall 32*b* of the orbiting scroll 32. The fixed spiral wall 31*b* and the orbiting spiral wall 32*b* each include a first end E located at the central side of a spiral and a second end S located at the outer side of the spiral. The fixed spiral wall 31*b* and the orbiting spiral wall 32*b* each extend spirally from the first end E to the second end S.

Figure 3:
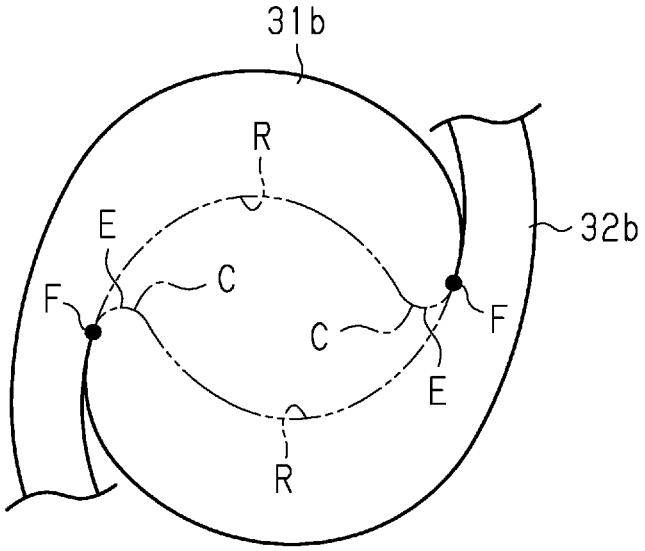
FIG. 3 is an enlarged view showing a first end and an arcuate portion of each of the fixed spiral wall and the orbiting spiral wall.

The first ends E of the fixed spiral wall 31*b* and the orbiting spiral wall 32*b* each include an arc C as shown by the single-dashed lines in FIG. 3. Further, the outer circumferential surfaces of the fixed spiral wall 31*b* and the orbiting spiral wall 32*b* each include an involute curve extending from the second end S to one side of the arc C in the first end E as shown by the solid lines in FIG. 3. The inner circumferential surfaces of the fixed spiral wall 31*b* and the orbiting spiral wall 32*b* each include an involute curve and an arc. The involute curve extends from the second end S to immediately before the first end E. The arc extends from a terminating point F of the involute curve to the other side of the arc C in the first end E as shown by the double-dashed lines in FIG. 3. The arc formed between the terminating point F of the involute curve and the arc C in the first end E is referred to as the arcuate portion R. The arcuate portion R is continuous with the distal end (first ends E) of the fixed spiral wall 31*b* or the orbiting spiral wall 32*b*. The involute curve switches to the arcuate portion R at the terminating point F in the inner circumferential surface of each of the fixed spiral wall 31*b* and the orbiting spiral wall 32*b*.

An involute curve is a planar curve of a path taken by an end of a normal set on a base circle and moved in constant contact with the base circle. An involute curve may also be referred to as an evolvent. In the inner circumferential surface of each of the fixed spiral wall 31*b* and the orbiting spiral wall 32*b*, the terminating point F located immediately before the first end E corresponds to the winding initiation point of the involute curve, and the second end S corresponds to the winding termination point of the involute curve. In the outer circumferential surface of each of the fixed spiral wall 31*b* and the orbiting spiral wall 32*b*, one side of the arc C in the first end E corresponds to the winding initiation point of the involute curve, and the second end S corresponds to the winding termination end of the involute curve.

The inner circumferential surfaces of the fixed spiral wall 31*b* and the orbiting spiral wall 32*b* each include the arcuate portion R located immediately before the first end E. This limits fluid leakage from the central compression chamber 33*c* when the first end E of one of the fixed spiral wall 31*b* and the orbiting spiral wall 32*b* contacts the inner circumferential surface of the other spiral wall as shown in FIG. 2.

Figure 6:
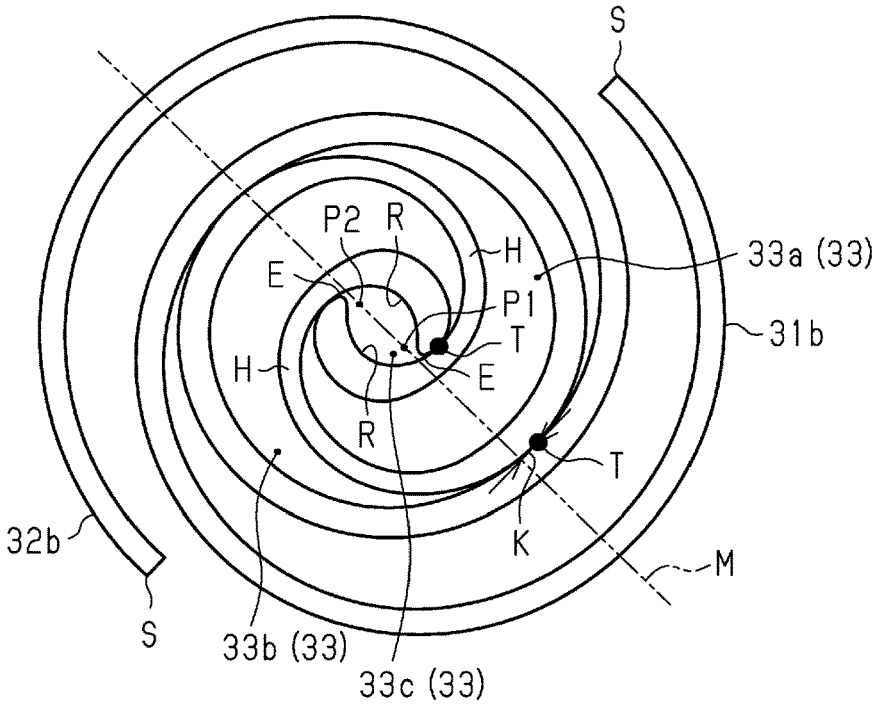
FIG. 6 is a diagram showing a distal end contact initiation angle and a central compression chamber.

As shown in FIG. 6, the center of a base circle (not shown) of the involute curve of the fixed spiral wall 31*b* is referred to as a fixed base circle center P1, and the center of a base circle (not shown) of the involute curve of the orbiting spiral wall 32*b* is referred to as an orbiting base circle center P2. The fixed base circle center P1 and the orbiting base circle center P2 lie along a straight line referred to as a radial direction line M. The radial direction line M is a straight line that extends in the radial direction of the base circles.

As shown in FIGS. 2 to 6, formation points T are formed at locations where the fixed spiral wall 31*b* and the orbiting spiral wall 32*b* contact each other. The number of the formation points T differs depending on the number of windings in the fixed spiral wall 31*b* and the orbiting spiral wall 32*b*. One formation point T is formed when the outer circumferential surface of the orbiting spiral wall 32*b* and the inner circumferential surface of the fixed spiral wall 31*b* contact each other. Another formation point T is formed when the inner circumferential surface of the orbiting spiral wall 32*b* and the outer circumferential surface of the fixed spiral wall 31*b* contact each other. A further a formation point T is formed when the first end E of the fixed spiral wall 31*b* and the inner circumferential surface of the orbiting spiral wall 32*b* contact each other. A formation point T is also formed when the first end E of the orbiting spiral wall 32*b* and the inner circumferential surface of the fixed spiral wall 31*b* contact each other. As the orbiting scroll 32 orbits, the formation points T move along the fixed spiral wall 31*b* toward the first ends E, and the movement of the formation points T changes the volumes of the first compression chamber 33*a* and the second compression chamber 33*b*.

FIG. 2 shows the fixed spiral wall 31*b* and the orbiting spiral wall 32*b*, each having about two and a half windings. As shown in FIG. 2, one formation point T located near the second end S of the fixed spiral wall 31*b* moves along the fixed spiral wall 31*b* for about two and a half windings to the first end E of the fixed spiral wall 31*b*. Another formation point T located near the second end S of the orbiting spiral wall 32*b* moves along the orbiting spiral wall 32*b* for about two and a half windings to the first end E of the orbiting spiral wall 32*b*. The positions of the formation points T that move along the fixed spiral wall 31*b* and the orbiting spiral wall 32*b* correspond to the orbiting angle of the orbiting scroll 32. The maximum value of the orbiting angle is equal to an orbiting termination angle. An orbiting angle when one formation point T located near each second end S, that is, when compression of the fluid trapped in the compression chamber 33 initiates, is referred to as an orbiting initiation angle.

Figure 4:
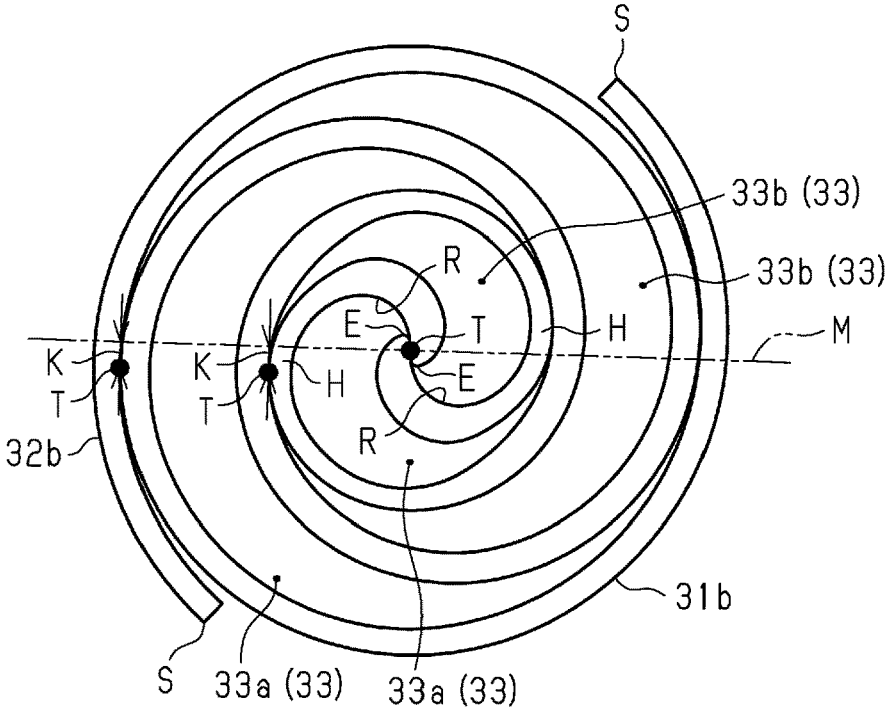
FIG. 4 is a diagram showing the fixed spiral wall and the orbiting spiral wall at a time point when compression is completed.

As shown in FIG. 4, when the orbiting angle is the orbiting termination angle, two formation points T have reached the first ends E of the fixed spiral wall 31*b* and the orbiting spiral wall 32*b*. Specifically, the two formation points T are in conformance with each other. When the formation points T reach the first ends E, the volume of the central compression chamber 33*c* is zero, and the compression of fluid in the central compression chamber 33*c* is completed.

Referring to FIG. 2, the distance between a formation point T and the radial direction line M is referred to as a formation point distance K. Specifically, the formation point distance K is the length of a normal extending from the formation point T to the radial direction line M. When two formation points T are arranged near the second ends S of the fixed spiral wall 31*b* and the orbiting spiral wall 32*b*, the formation points T are separated from the radial direction line M, and the formation point distance K is greater than zero.

Further, as shown in FIG. 6, even when the central compression chamber 33*c* is formed, the formation points T are separated from the radial direction line M, and the formation point distance K is greater than zero. Further, as shown in FIG. 4, when one formation point T moves to the first ends E of the fixed spiral wall 31*b* and the orbiting spiral wall 32*b*, that is, when the orbiting angle reaches the orbiting termination angle, the formation point T is located on the radial direction line M, and the formation point distance K is zero. When the orbiting angle is not the orbiting termination angle, the formation point T is separated from the radial direction line M, and the formation point distance K is greater than zero.

Figure 7:
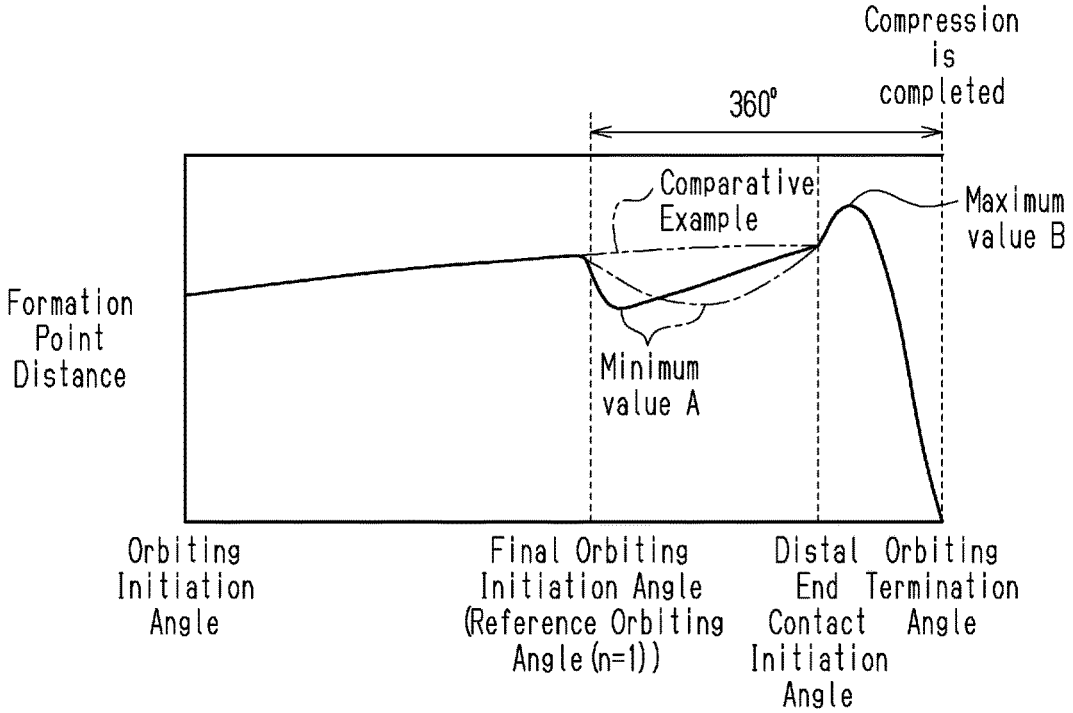
FIG. 7 is a graph showing the relationship between the orbiting angle and the formation point distance.

The graph of FIG. 7 shows the relationship of the orbit angle and the formation point distance K. The formation point distance K sharply increases (sharply changes) before fluid compression is completed in the central compression chamber 33*c*. This is because when a formation point T where the first end E of the orbiting spiral wall 32*b* contacts the inner circumferential surface of the fixed spiral wall 31*b* and a formation point T where the inner circumferential surface of the fixed spiral wall 31*b* contacts the first end E of the orbiting spiral wall 32*b* each move from the portion of the involute curve to the arcuate portion R, the positions where the formation points T are located changes.

In the description hereafter, the orbiting angle at the position where contact initiates between the first end E and the arcuate portion R is referred to as a distal end contact initiation angle. The distal end initiation angle is the orbiting angle where the first end E of the orbiting spiral wall 32*b* contacts the arcuate portion R defined by the inner circumferential surface of the fixed spiral wall 31*b* before compression is completed in the central compression chamber 33*c*. As shown in FIG. 3, the distal end contact initiation angle is also where the position of a formation point T switches from the involute curve to the arcuate portion R at the terminating point F on the inner circumferential surfaces of the fixed spiral wall 31*b* and the orbiting spiral wall 32*b*. After the formation point T passes by the distal end contact initiation angle, the formation point T moves along the arcuate portion R. As a result, the formation point distance K sharply increases and then sharply decreases and becomes zero when compression is completed.

Further, as shown in FIGS. 2 and 4 to 6, the fixed spiral wall 31*b* and the orbiting spiral wall 32*b* each include a varying portion H having a gradually varying wall thickness. The varying portion H is closer to the second end S than the arcuate portion R is. In other words, the varying portion H is located radially outward from the arcuate portion R. The varying portion H, which is arranged closer to the second end S than the first end E and the arcuate portion R, has a wall thickness that gradually decreases from the second end S toward the first end E and then gradually increases to its original thickness as the varying portion H further extends toward the first end E and the arcuate portion R. That is, the wall thickness of the varying portion H gradually decreases and then gradually increases as the varying portion H extends spirally inward in the radial direction. Accordingly, as a formation point T passes by the varying portion H, the formation point T moves along a closer path toward the first end E so that the formation point distance K decreases as compared to when the formation point distance K does not pass by the varying portion H.

The change in the formation point distance K in the range from the orbiting initiation angle to the orbiting termination angle will now be described.

As shown in the graph of FIG. 7, the formation point distance K does not greatly change from the orbiting initiation angle (0°), at which fluid compression is initiated, and gradually increases. In a range of the orbiting angle at which the formation point T passes by the varying portion H, the formation point distance K sharply changes as shown by the solid lines or the single-dashed lines in the graph of FIG. 7. For example, the formation point distance K decreases in a non-gradual manner as shown in FIG. 7 when the formation point T starts passing by the varying portion H as shown in FIG. 5. Then, the formation point distance K gradually increases to the distance that is obtained before passing by the varying portion H at the distal end contact initiation angle as shown in FIG. 7 when the formation point T approaches the arcuate portion R as shown in FIG. 6. Then, the formation point distance K sharply increases (sharply changes), sharply decreases, and becomes zero before fluid compression is completed in the central compression chamber 33*c*.

The varying portion H is located at a position where the varying portion H increases and decreases the formation point distance K in a non-gradual manner before the formation point distance K becomes zero, that is, before the time point when compression is completed. The range in which the varying portion H can be provided will now be described using the orbiting angle. Orbiting angles obtained by subtracting an integer multiple (n) of 360° from the orbiting termination angle will be referred to as the reference orbiting angle. In particular, the reference orbiting angle when n=1 is satisfied will be referred to as the final orbiting initiation angle. Here, n of the integer multiple is an integer that is smaller than or equal to the number of windings of the fixed spiral wall 31*b* and the orbiting spiral wall 32*b*. The varying portion H is set so that the formation point distance K reaches a minimum value at least at one of an orbiting angle in the range from the final orbiting initiation angle to the distal end contact initiation angle or an orbiting angle obtained by subtracting an integer multiple of 360° from the orbiting angle in the range from the final orbiting initiation angle to the distal end contact initiation angle. The term "minimum value" may be used to refer to a local minimum value.

In the present embodiment, the varying portion H is set so that the formation point distance K reaches the minimum and smallest value at a preset orbiting angle (first orbiting angle) as shown by the solid lines in FIG. 7. Specifically, the formation point distance K reaches the minimum value A at the first orbiting angle. The first orbiting angle is in the range from the orbiting initiation angle to the orbiting termination angle and also in the range from the final orbiting initiation angle to the distal end contact initiation angle. The first orbiting angle is positioned immediately after the final orbiting initiation angle. In this case, the formation point distance K reaches the minimum and smallest value among the orbiting angles between the orbiting initiation angle and the distal end contact initiation angle. In other words, the formation point distance K reaches the minimum and smallest value at the first orbiting angle in the range from the orbiting initiating angle to the distal end contact initiation angle. The formation point distance K sharply decreases in a non-gradual manner at angles toward the first end E from the final orbiting initiation angle. After reaching the minimum value, the formation point distance K sharply increases toward the first end E in accordance with the thickness of portions other than the varying portion H. That is, the formation point distance K sharply decreases, reaches the minimum value, and then sharply increases as the orbiting angle increases from the final orbiting initiation angle. The varying portion H may be set so that the formation point distance K reaches the minimum and smallest value at an orbiting angle obtained by subtracting an integer multiple of 360° immediately after the final orbiting initiation angle, which is an orbiting angle in the range from the final orbiting initiation angle to the distal end contact initiation angle between the orbiting initiation angle and the orbiting termination angle. That is, the varying portion H may be set so that the formation point distance K reaches the minimum and smallest value at the second orbiting angle, which is an orbiting angle obtained by subtracting the integer multiple of 360° from the first orbiting angle. The formation point distance K may be the minimum and smallest value at the second orbiting angle in the range from the orbiting initiation angle to the distal end contact initiation angle.

As shown by the single-dashed line in FIG. 7, the varying portion H may be set so that the formation point distance K reaches the minimum value (minimum value A) at a preset orbiting angle (first orbiting angle) near the middle of the range from the final orbiting initiation angle to the distal end contact initiation angle between the orbiting initiation angle and the orbiting termination angle. Instead, the varying portion H may be set so that the formation point distance K reaches the minimum value at the second orbiting angle, which is an orbiting angle obtained by subtracting an integer multiple of 360° from the first orbiting angle.

Further, although not shown in the drawings, the varying portion H may be set so that the formation point distance K reaches the minimum value (minimum value A) at a preset orbiting angle (first orbiting angle) near the distal end contact initiation angle in the range from the final orbiting initiation angle to the distal end contact initiation angle between the orbiting initiation angle and the orbiting termination angle. Instead, the varying portion H may be set so that the formation point distance K reaches the minimum value at the second orbiting angle, which is an orbiting angle obtained by subtracting an integer multiple of 360° from the first orbiting angle.

Figure 8:
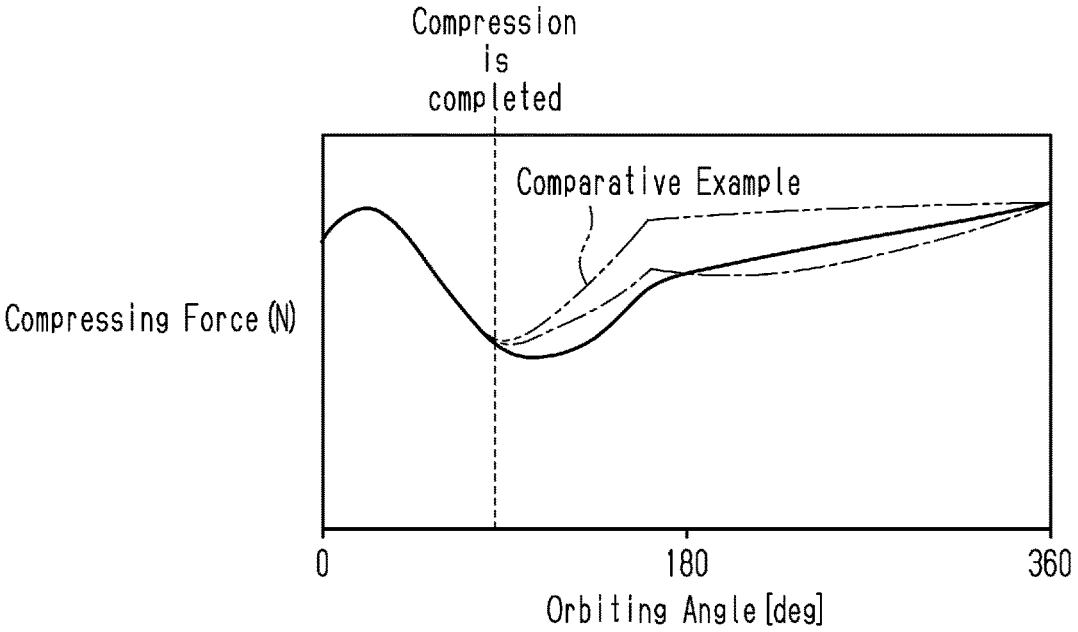
FIG. 8 is a graph showing the relationship between the orbiting angle and the compressing force.

The relationship between the orbiting angle and the compressing force (N) will now be described. The graph of FIG. 8 shows the relationship between the orbiting angle and the radial component of a compressing force in the axis L. The graph of FIG. 8 shows the range of the orbiting angle in the graph of FIG. 7 from when the formation point T starts to pass by the arcuate portion R immediately before compression is completed and the formation point distance K starts to sharply increase to when the orbiting scroll 32 finishes a single orbit. The compressing force is the sum of the reaction forces generated when fluid is compressed in the compression chambers 33. The compressing force increases as compression of the fluid progresses.

As shown in the graph of FIG. 7, when the formation point distance K starts to increase after passing by the distal end contact initiation angle immediately before compression is completed, the compressing force gradually increases. After the formation point distance K reaches a maximum value B, the compressing force sharply decreases toward the completion of compression. This is because fluid, which has been compressed at the maximum pressure in the central compression chamber 33*c*, is discharged out of the discharge port 41.

Figure 9:
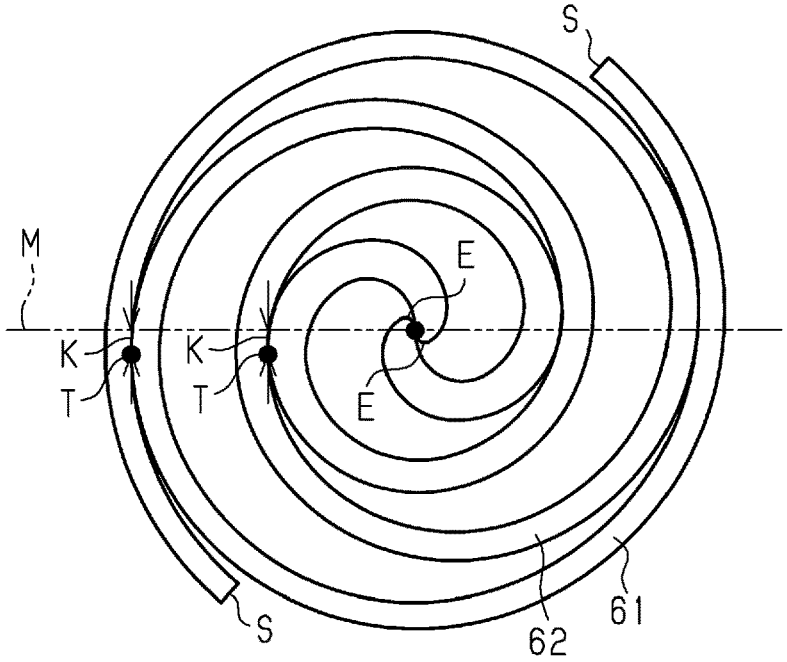
FIG. 9 is a diagram showing a fixed spiral wall and an orbiting spiral wall in a comparative example.

FIG. 9 shows a fixed spiral wall 61 and an orbiting spiral wall 62 in a comparative example. The fixed spiral wall 61 and the orbiting spiral wall 62 do not include the varying portion H. Thus, the wall thickness does not sharply vary in the fixed spiral wall 61 and the orbiting spiral wall 62. In the graph of FIG. 7, the double-dashed line shows the relationship between the formation point distance K and the orbiting angle in the comparative example. In the graph of FIG. 8, the double-dashed line shows the relationship between the compressing force and the orbiting angle in the comparative example.

As shown by the double-dashed line in the graph of FIG. 7, the formation point distance K is not sharply changed in the comparative example even at the orbiting angle after the final orbiting initiation angle obtained by subtracting 360° from the time point when compression is completed (orbiting termination angle), that is, during discharge after the completion of compression. This causes the compressing force during discharge to sharply decrease just before compression is completed and then sharply increase in the comparative example as shown by the double-dashed line in FIG. 8.

In contrast, as shown by the solid lines or the single-dashed lines in FIG. 8, in the present embodiment, the varying portion H is located so that the formation point distance K reaches the minimum value A at an orbiting angle in the range from the final orbiting initiation angle to the distal end contact initiation angle or an orbiting angle obtained by subtracting an integer multiple of 360° from an orbiting angle in the range from the final orbiting initiation angle to the distal end contact initiation angle. Thus, as shown by the solid lines or the single-dashed lines in FIG. 8, during discharge after the completion of compression, the radial component of a compressing force gradually increases.

The varying portion H is set at an orbiting angle orbited from the final orbiting initiation angle obtained by subtracting 360° from the time point when compression is completed (orbiting termination angle). As a result, during discharge after the completion of compression in the central compression chamber 33*c*, the compressing force is changed so that the formation point distance K of the other compression chambers 33 is sharply decreased to reach the minimum value A. In other words, when a change in the compressing force occurs as a result of the discharging action of the central compression chamber 33*c*, the compressing force also changes in the other compression chambers (first compression chamber 33*a* and second compression chamber 33*b*). Thus, the compressing forces cancel out each other to gradually increase the compressing force.

The above embodiment has the following advantages.

(1) The fixed spiral wall 31*b* and the orbiting spiral wall 32*b* of the scroll compressor 10 include the varying portion H of which the wall thickness gradually varies. The varying portion H is set so that the formation point distance K reaches the minimum value at least at one of the first orbiting angle, which is an orbiting angle in the range from the final orbiting initiation angle to the distal end contact initiation angle, or the second orbiting angle, which is an orbiting angle obtained by subtracting an integer multiple of 360° from the first orbiting angle. Thus, during discharge after the compression of fluid in the central compression chamber 33*c* is completed, the compressing force is changed in the other compression chambers 33 (first compression chamber 33*a* and second compression chamber 33*b*). As a result, the changes in the compressing force cancel out each other during discharge after the compression is completed so that the compressing force gradually increases. In other words, changes in the compressing force cancel out each other in the central compression chamber 33*c* and the other compression chambers 33 (first compression chamber 33*a* and second compression chamber 33*b*) and reduces sharp increases in the compressing force generated from the completion of compression to discharging. This reduces sharp changes in the compressing force, reduces vibration of the scroll compressor 10, and reduces noise resulting from vibration.

(2) The formation point distance K and the change in compressing force when the formation point T moves from the second end S to the first end E are adjusted. The formation point distance K is sharply changed so that the formation point distance K reaches the minimum value at least at one of the first orbiting angle, which is an orbiting angle in the range from the final orbiting initiation angle to the distal end contact initiation angle, or the second orbiting angle, which is an orbiting angle obtained by subtracting an integer multiple of 360° from the first orbiting angle. As a result, changes in the compressing force cancel out each other during discharge after the compression is completed so that the compressing force gradually increases. The formation point distance K is adjusted by varying the wall thickness of the fixed spiral wall 31*b* and the orbiting spiral wall 32*b* to reduce sharp changes in the compressing force without increasing the fixed spiral wall 31*b* and the orbiting spiral wall 32*b* in size. Further, only the wall thickness of the fixed spiral wall 31*b* and the orbiting spiral wall 32*b* need to be adjusted. Thus, changes in the compressing force are reduced without, for example, additional parts.

(3) The formation point distance K is configured to reach the minimum and smallest value, among the orbiting angles between the orbiting initiation angle and the distal end contact initiation angle, at the first orbiting angle, which is an orbiting angle in the range from the final orbiting initiation angle to the distal end contact initiation angle, or the second orbiting angle, which is an orbiting angle obtained by subtracting an integer multiple of 360° from the first orbiting angle. That is, the formation point distance K reaches the minimum and smallest value at one of the first orbiting angle and the second orbiting angle in the range from the orbiting initiation angle to the distal end contact initiation angle. Thus, the compressing force is sharply changed at the orbiting angle at which the formation point distance K reaches the minimum and smallest value. As a result, changes in the compressing force cancel out each other in the central compression chamber 33*c* and the other compression chambers 33, and sharp increases are significantly reduced in the compressing force generated from the completion of compression to discharge. This significantly reduces sharp changes in the compressing force and significantly reduces vibration.

The above embodiment may be modified as described below.

The formation point distance K may reach the minimum value at only a single location or at multiple locations regardless of the number of windings of the fixed spiral wall 31*b* and the orbiting spiral wall 32*b*. For example, in the present embodiment, the two locations where the formation point distance K reaches the minimum value (two locations where formation point distance K reaches the minimum value A) may correspond to an orbiting angle that is obtained by subtracting 360° (n=1) from a preset orbiting angle in the range from the final orbiting initiation angle to the distal end contact initiation angle and an orbiting angle that is obtained by subtracting 720° (n=2) from the preset orbiting angle.

The number of locations where the formation point distance K reaches the minimum value may be changed in accordance with the number of windings of the fixed spiral wall 31*b* and the orbiting spiral wall 32*b*.

In the present embodiment, the formation point distance K is defined as the distance between the radial direction line M and the point where the compression chamber 33 is formed when the fixed spiral wall 31*b* and the orbiting spiral wall 32*b* are in contact with each other. However, the formation point distance K is not limited in such a manner. As long as fluid leakage through a gap is subtle, the formation point may be a point where the compression chamber 33 is formed when the fixed spiral wall 31*b* and the orbiting spiral wall 32*b* are in proximate to each other. The distance between the formation point and the radial direction line M may be referred to as the formation point distance K.

The minimum value A described above is reached in a non-continuous change in a proximity point distance. However, the minimum value A may be reached in a continuous change in a proximity point distance. In other words, the minimum value A is not limited to a value obtained when the formation point distance K changes in a non-gradual manner. The minimum value A may be obtained when the formation point distance K changes in a gradual manner.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor comprising:

a fixed scroll including a fixed base and a fixed spiral wall extending from the fixed base; and an orbiting scroll including an orbiting base, which is opposed to the fixed base, and an orbiting spiral wall, which extends from the orbiting base toward the fixed base and is engaged with the fixed spiral wall, wherein the fixed scroll and the orbiting scroll are configured to cooperate to form a compression chamber, the scroll compressor is configured to compress fluid in the compression chamber when the orbiting scroll orbits, the fixed spiral wall extends along an involute curve, the involute curve of the fixed spiral wall has a base circle with a center referred to as a fixed base circle center, the orbiting spiral wall extends along an involute curve, the involute curve of the orbiting spiral wall has a base circle with a center referred to as an orbiting base circle center, the fixed base circle center and the orbiting base circle center lie along a straight line referred to as a radial direction line, the fixed spiral wall and the orbiting spiral wall come into contact with each other or are proximate to each other at a location referred to as a formation point, the fixed spiral wall and the orbiting spiral wall are configured to form the compression chamber when in contact with each other or located proximate to each other at the formation point, the radial direction line and the formation point are spaced apart by a distance referred to as a formation point distance, the fixed spiral wall has an inner circumferential surface including an arcuate portion continuous with a distal end of the fixed spiral wall, an orbiting angle of the orbiting scroll when the compression chamber is formed and compression of fluid is initiated is referred to as an orbiting initiation angle, an orbiting angle of the orbiting scroll when the compression of the fluid is completed is referred to as an orbiting termination angle, an orbiting angle of the orbiting scroll when an end of the orbiting spiral wall initiates contact with the arcuate portion of the fixed spiral wall before compression is completed is referred to as a distal end contact initiation angle, an orbiting angle obtained by subtracting 360° from the orbiting termination angle is referred to as a final orbiting initiation angle, an orbiting angle in a range from the orbiting initiation angle to the orbiting termination angle and in a range from the final orbiting initiation angle to the distal end contact initiation angle is referred to as a first orbiting angle, an orbiting angle in the range from the orbiting initiation angle to the orbiting termination angle and obtained by subtracting an integer multiple of 360° from the first orbiting angle is referred to as a second orbiting angle, and the formation point distance reaches a minimum value at least at one of the first orbiting angle or the second orbiting angle.

2. The scroll compressor according to claim 1, wherein in the range from the orbiting initiation angle to the distal end contact initiation angle, the formation point distance reaches a minimum and smallest value at one of the first orbiting angle and the second orbiting angle.

* * * * *